US005989678A

United States Patent [19]

Jacobson

[11] Patent Number: 5,989,678

[45] **Date of Patent: *Nov. 23, 1999**

[54] METHOD OF SIMULTANEOUSLY PRINTING A PORTION OF A HOOK AND LOOP FABRIC AND ATTACHING THE FABRIC TO ANOTHER FABRIC AND THE FABRIC OR GARMENT RESULTING THEREFROM

[76] Inventor: Laurence Jacobson, 393 West End Ave. Apartment 17C, New York, N.Y. 10024

[ * ] Notice: This patent issued on a continued prosecution application filed under 37 CFR 1.53(d), and is subject to the twenty year patent term provisions of 35 U.S.C. 154(a)(2).

[21] Appl. No.: 08/668,339

[22] Filed: Jun. 25, 1996

[51] Int. Cl.[6] ..... B32B 3/06

[52] U.S. Cl. ..... 428/100

[58] Field of Search ..... 428/100

[56] References Cited

U.S. PATENT DOCUMENTS

| | | | |
|---|---|---|---|
| 2,479,246 | 8/1949 | Lupo . | |
| 2,685,690 | 8/1954 | Chrisman . | |
| 2,871,485 | 2/1959 | Greco . | |
| 2,889,233 | 6/1959 | Steffey . | |
| 3,296,963 | 1/1967 | Rarey et al. . | |
| 3,484,974 | 12/1969 | Culmone | 428/100 |
| 3,880,429 | 4/1975 | Blumenaus . | |
| 4,092,451 | 5/1978 | Sernaker . | |
| 4,142,929 | 3/1979 | Otomine et al. . | |
| 4,249,268 | 2/1981 | Berler . | |
| 4,277,848 | 7/1981 | Boehland . | |
| 4,354,282 | 10/1982 | Langdon . | |
| 4,440,590 | 4/1984 | Collins et al. . | |
| 4,470,861 | 9/1984 | Kravig et al. . | |
| 4,513,454 | 4/1985 | Anderson et al. . | |
| 4,542,691 | 9/1985 | Kokrhanek . | |
| 4,611,355 | 9/1986 | Gallanto et al. . | |
| 4,627,110 | 12/1986 | Tengs . | |
| 4,644,589 | 2/1987 | Pettis . | |
| 4,671,514 | 6/1987 | Wilson-Diehl . | |
| 4,699,385 | 10/1987 | Bifulco . | |
| 4,710,979 | 12/1987 | Bull et al. . | |
| 4,710,981 | 12/1987 | Sanchez | 2/115 |
| 4,734,298 | 3/1988 | Kikukawa . | |
| 4,737,225 | 4/1988 | Waugh et al. . | |
| 4,776,043 | 10/1988 | Coleman . | |
| 4,837,864 | 6/1989 | Thill . | |
| 4,860,387 | 8/1989 | Williams . | |
| 4,890,347 | 1/1990 | Fuller | 428/100 |
| 4,923,848 | 5/1990 | Akada et al. | 503/227 |
| 4,937,181 | 6/1990 | Rogers . | |
| 4,953,870 | 9/1990 | Norman et al. . | |
| 5,000,090 | 3/1991 | Tecl et al. . | |
| 5,086,816 | 2/1992 | Baxter et al. | 428/100 |
| 5,136,726 | 8/1992 | Kellin et al. | 428/100 |
| 5,268,210 | 12/1993 | Iijima | 428/100 |
| 5,344,356 | 9/1994 | Pizzelli et al. | 428/100 |
| 5,528,773 | 6/1996 | Lowinger | 2/161.4 |

FOREIGN PATENT DOCUMENTS

| | | |
|---|---|---|
| 1497611 | 10/1967 | France . |

*Primary Examiner*—Terrel Morris
*Attorney, Agent, or Firm*—Michael R. Gilman, Esq.; Kaplan & Gilman, L.L.P.

[57] ABSTRACT

An improved method of simultaneously printing a hook and loop fabric and adhering the fabric to another fabric or garment is provided. The method comprises the steps of applying a heat and pressure sensitive coating to one side of the hook and loop fabric, placing that fabric over a portion of another fabric or garment so that the hook and loop fabric touches the other fabric or garment, heating the two fabrics to commence activation of the coating, applying a printing material onto the hook and loop fabric and compressing the two fabrics together at an appropriate temperature and pressure, and for an appropriate time interval, to complete the activation of the coating so as to adhere the fabrics together and to activate the printing material. The resulting fabric or garment has a hook and loop fabric attached thereto in an unremovable, non-shifting manner due to adhesion of the two fabrics from the coating. The hook and loop fabric will, in addition, have an ornamental design printed thereon as a result of the application of the printing material.

9 Claims, 3 Drawing Sheets

METHOD OF SIMULTANEOUSLY PRINTING A PORTION OF A HOOK AND LOOP FABRIC AND ATTACHING THE FABRIC TO ANOTHER FABRIC AND THE FABRIC OR GARMENT RESULTING THEREFROM

BACKGROUND OF THE INVENTION

This invention relates to the garment field, and more particularly, to a method of applying a print design to standard hook and loop fabric (for example, Velcro®), while simultaneously attaching the hook and loop fabric to an underlying fabric or garment.

Hook and loop fabrics are old in the art. Fabric and garments having other hook and loop fabric attached thereto is also old in the art.

Garments, such as shirts, sweatshirts, pants and hats, have long since been printed with ornamental designs. Methods of printing fabric which are known in the art include, among others, screenprinting, heat transfer printing and belt printing.

In its basic form, screenprinting consists of the alternating application of laying different screens over the same area of an underlying fabric or garment and the application of different colored printing material (inks, paints, etc.) applied with pressure over each screen. Each of the screens has a print element or portion of the overall design to be placed onto the fabric or garment. When the full set of screens (one or more screens), and their different colors, have been completely applied to the fabric or garment, a complete underlying design can be seen on the fabric or garment.

Belt printing uses substantially the same steps as screenprinting, but with the added mechanization of the cut fabric or garment proceeding along on a conveyor belt to different stations of screenprinting presses.

Heat transfer printing consists of the taking of an applique (which is transfer paper having a design printed thereon and treated with a heat and pressure sensitive adhesive on the back thereof), and transferring the design element of the applique onto a fabric or garment. The applique is transferred to the fabric or garment by applying the appropriate heat and pressure, for an appropriate period of time, thereby fusing the applique to the fabric or garment so that the ornamental design is visible on the outside of the fabric or garment.

It became popular to further adorn fabrics and garments with hook and loop fabric pieces, such as Velcro®, so that removable ornamental pieces, such as figures of people or animals or writing, could be removably attached to interact with the printed-on design. It was a disadvantage of these types of systems that the hook and loop fabric pieces, onto which the detachable ornamental pieces could be placed, and which were interspersed around the fabric or garment, did not also contain any design features to allow them to blend into the surrounding or background picture. For example, if the system involved was a blue sky which incorporated different positions for a detachable element such as the sun, any position on which to place the sun would need to have a piece of the hook and loop fabric adhered or stitched over a part of the blue sky background. The hook and loop fabric would not necessarily be the same color as the blue sky background, and therefore, when no sun element was affixed to a particular hook and loop piece, that piece would be visible and disrupt the beauty of the underlying picture, it would also not be the same texture of the background picture.

Accordingly, it would be desirable to provide a method of printing the hook and loop fabric itself with the ornamental background design while maintaining the integrity of the hook and loop structure, so that removable ornamental elements could be affixed onto the design in any location to interact with that design.

Since the hook and loop fabric is different than the underlying fabric of the garment (usually cotton, polyester, a cotton-polyester blend or any other type of natural or synthetic fabric), it is also a disadvantage to stitch a hook and loop fabric to the underlying fabric or garment since different shrinkage coefficients exist for the two fabrics and the hook and loop fabric would ultimately crumple up or become detached from the garment during repeated wash cycles. Accordingly, it would also be advantageous to provide a method of resolving this attachment problem, while also enabling the hook and loop fabric to be printed.

SUMMARY OF THE INVENTION

In accordance with the invention, an improved method of simultaneously printing a hook and loop fabric and adhering the fabric to another fabric or garment is provided.

The method comprises the steps of applying a heat and pressure sensitive coating to one side of the hook and loop fabric, placing that fabric over a portion of another fabric or garment so that the hook and loop fabric touches the other fabric or garment, heating (flashing) the two fabrics to commence activation of the coating, applying a printing material onto the hook and loop fabric and compressing the two fabrics together at an appropriate temperature and pressure, and for an appropriate time interval, to complete the activation of the coating so as to adhere the fabrics together and to activate the printing material.

The resulting fabric or garment has a hook and loop fabric attached thereto in an unremovable, non-shifting manner due to adhesion of the two fabrics from the coating. The hook and loop fabric will, in addition, have an ornamental design printed thereon as a result of the application of the printing material.

Accordingly, it is an object of the invention to provide an improved method of attaching a hook and loop fabric to a base fabric or garment, wherein the hook and loop fabric contains an ornamental design printed thereon.

Still a further object of the invention is to provide a method of printing an ornamental design onto hook and loop fabric without the hook and loop fabric losing its engagement properties.

Yet another object of the invention is to provide a method of adhering and printing a hook and loop fabric to an underlying fabric or garment so that the hook and loop fabric and the underlying fabric or garment are compatible for machine washing so as to overcome the differences in shrinkage factors between the fabrics.

Still another object of the invention is to provide a one step method of printing a hook and loop fabric and adhering that fabric to an underlying fabric or garment.

Other objects of the invention will in part be obvious and will in part be apparent from the following description.

The invention accordingly comprises a method of producing a product and the resulting product, possessing the features and properties hereinafter described, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

Figure 1:
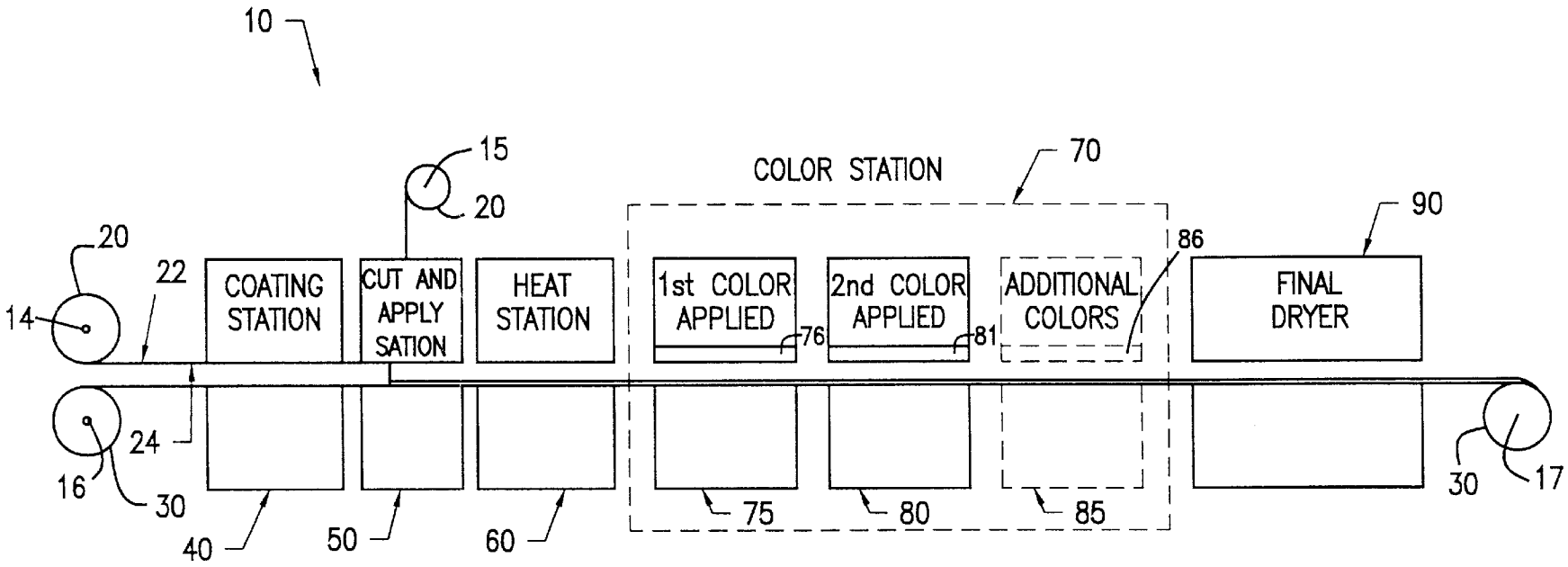
FIG. 1 is a schematic of a method of simultaneously printing a hook and loop fabric and adhering that fabric to an underlying fabric or garment.

Referring to FIG. 1, a schematic of a system for simultaneously printing a hook and loop fabric and attaching the fabric to another fabric, in accordance with the invention and generally designated at 10, is illustrated. System 10 has a spool of hook and loop fabric 20, and a spool of other fabric 30. The other fabric 30 can be cotton, polyester, rayon, lycra, or any other natural or synthetic fabric known to be applicable to the clothing trade, or any combination thereof.

Continuing with FIG. 1, system 10 also has the following stations, coating station 40, cut and apply station 50, heat station 60, color station 70 and final dryer station 90. In a preferred application, the spool of hook and loop fabric 20, located on feed reel 14, and the spool of fabric 30, located on feed reel 16, are fed through system 10 starting at coating station 40 and ending at final dryer station 90. While going through system 10, and particularly at cut and apply station 50, some pre-determined size segment of hook and loop fabric 20 is cut and placed on top of a portion of fabric 30. The combination of the portion of fabric 20 which has been cut and applied onto fabric 30, proceeds through system 10 next entering heat station 60. The fabric 20 not cut out and applied to fabric 30 is seen in FIG. 1 to be taken-up onto take-up reel 15, which exits cut and apply station 50. Ultimately, the fabric 30 having the portion of fabric 20 thereon which exits cut and apply station 50 and enters heat station 60, completes the method of the system at final dryer 90, and is taken-up onto take-up reel 17. Fabric 30 and reel 17 will then ultimately be cut into garments, as will be discussed below.

Continuing with FIG. 1, at coating station 40, a second side 24 of hook and loop fabric 20 has applied thereto a heat and pressure activated coating. It is anticipated by the invention that any known method of applying such a coating can be applicable to the subject invention. The coating used is preferably activated at between 100° Fahrenheit and 400° Fahrenheit and at normal screenprinting pressures.

After coating station 40, fabrics 20 and 30 enter cut and apply station 50. At cut and apply station 50, fabric 20 is cut pursuant to a pre-planned geometric scheme, with the cut-out geometric portion thereof allowed to come to rest upon a portion of fabric 30 which is passing through system 10 at the time of cutting. It is anticipated that any geometric shape for the cut-out portion of fabric 20 can be used in the subject invention.

Upon leaving cut and apply station 50, the combined fabric 30 now enters heat station 60. Heat station 60 is designed to provide heat in the range of 100° Fahrenheit to 125° Fahrenheit. In this temperature range, the coating applied to second side 24 of fabric 20, now located between fabric 20 and fabric 30, begins to heat. The heating, also known as flashing, of the coating and fabrics, commences the activation of the coating, which activation ultimately will result in the uniform adhesion of second side 24 of fabric 20 onto fabric 30.

With all of the elements, the cut-out portion of fabric 20, the coating and fabric 30 having been heated at heat station 60, the combined fabric enters color station 70. In color station 70, conventional screenprinting is performed in order to apply a design element to a first side 22 of hook and loop fabric 20. It is to be understood that first side 22 of fabric 20 is the side having protruding therefrom either the hook elements or the loop elements of hook and loop fabric 20. Accordingly, the design applied at color station 70 is applied at least onto the hook or loop side of fabric 20. The invention also anticipates that the design element applied at color station 70 can be applied to both fabric 20 and fabric 30 so that the design encompasses both fabrics. The preferred coloring material for system 10 is plastisol ink.

Color station 70, as shown in FIG. 1, is broken down into first color station 75, second color station 80 and additional color stations 85. In conventional screenprinting, an overall design element having five different colors, for example, will need five different color stations, one station for each color. The invention anticipates any number of coloring stations.

The only non-conventional aspect of color station 70, and its individual coloring stations 75, 80 and/or 85, consists of use of the protective mesh boards 76, 81 and 86, respectively. These mesh boards are used in the inventive process during the conventional screenprinting process, between first side 22 of fabric 20 and the screen (not shown), in order to prevent undue flattening of the hook or loop elements of fabric 20. If either the hook or loop elements of the hook and loop fabric are overflattened in the screening step, the integrity of the hook and loop fabric to receive detachable ornamental pieces 260 (FIG. 4) having hook and loop fabric thereon, will not be maintained. In particular, if for example, first side 22 of fabric 20 were the loop elements of a conventional hook and loop fabric, detachable ornamental pieces 260 would have the counterpart hook elements of the hook and loop fabric extending therefrom. As is known to be the case with these standard-type hook and loop fabrics, as for example Velcro®, they only function properly, and maintain their connectability if the loop elements are able to receive the hook elements, i.e., if they are not overly flattened. The same is true regarding the hook elements.

Continuing with FIG. 1, after exiting color station 70, the combined fabric enters final dryer 90. In final dryer 90, heat in the range of 275° Fahrenheit to 350° Fahrenheit is applied to the combined fabric so that the coating is finally cured and so that the design element applied during color station 70, is also cured. Once the fully printed and cured fabric exits dryer 90, it is received onto take-up spool 17 for later transport to a location where the fabric can be cut and sewn into garments or other goods.

Figure 2B:
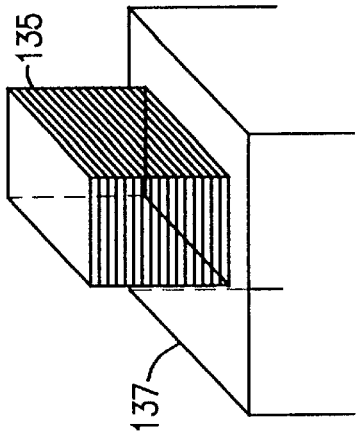
FIG. 2B is a perspective view of a stack of applique sheets.
Figure 2A:
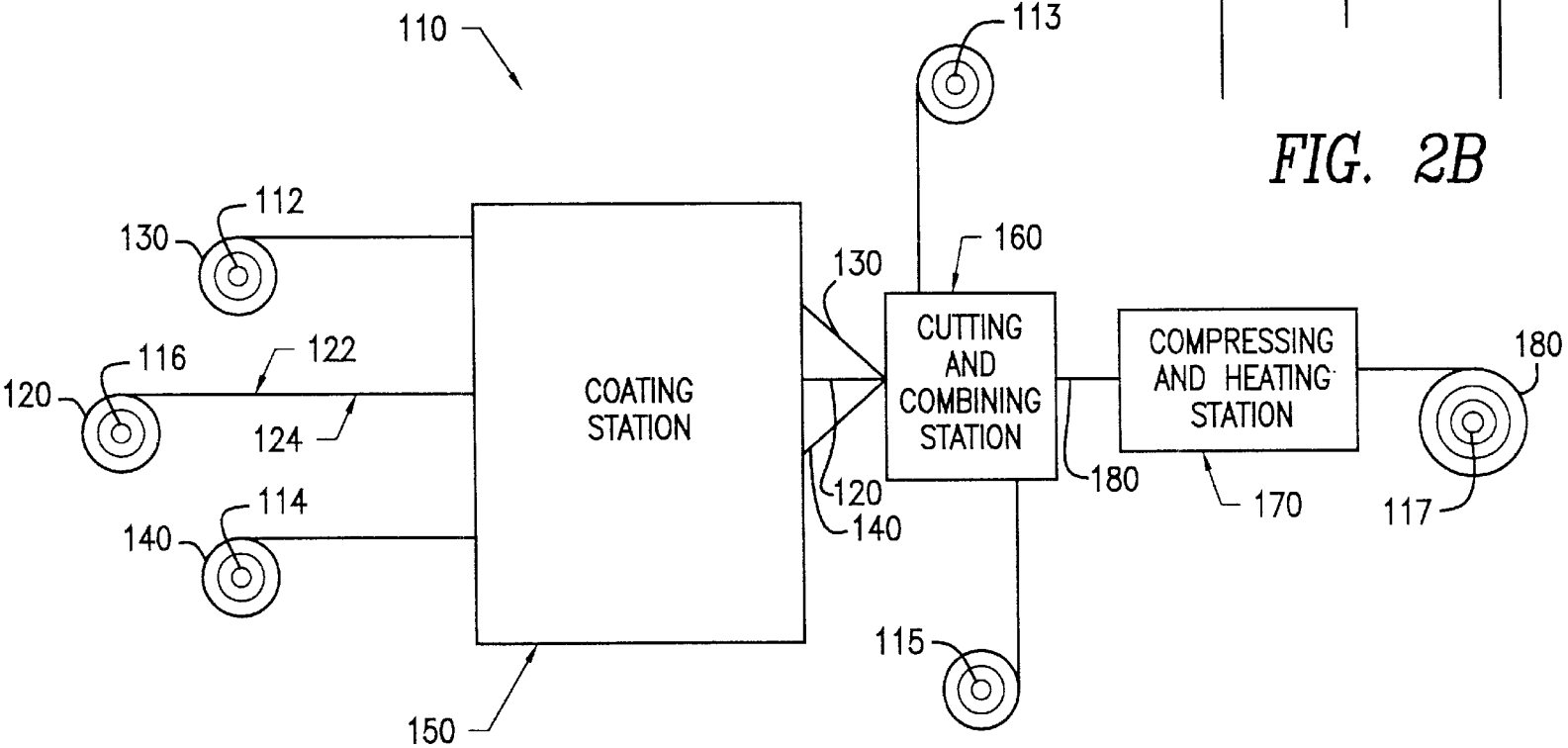
FIG. 2A is a schematic of a second embodiment of a method of simultaneously printing a hook and loop fabric and adhering that fabric to an underlying fabric or garment.

Turning now to FIGS. 2A and 2B, an alternate system 110 is shown. System 110, instead of using conventional screenprinting, as with system 10, uses a conventional applique method of applying the design element onto the hook and loop fabric and the underlying garment fabric, if desired.

System 110 comprises a coating station 150, a cutting and combining station 160 and a compressing and heating station 170. Three spools of materials are used in system 110, a roll of applique material 130 (FIG. 2A) or a stack of single sheet appliques 135 (FIG. 2B), a spool of hook and loop fabric 120 and a spool of the underlying fabric 140.

In operation, system 110 applies a similar heat and pressure activated coating as was applied in system 10, to second side 124 of hook and loop fabric 120 in coating station 150. Applique material 130 is normally activated at a temperature range of between 350° Fahrenheit and 425° Fahrenheit.

While it is shown in FIG. 2A that all three materials/fabrics enter and exit coating station 150, it is anticipated that since only fabric 120 is treated in coating station 150, applique material 130 or 135 and fabric 140 could bypass coating station 150, to first enter system 110 at cutting and combining station 160.

Continuing with FIG. 2A, after exiting coating station 150, all three materials/fabrics enter cutting and combining station 160. In cutting and combining station 160 the design element located on applique role 130 and a corresponding portion of hook and loop fabric 120 are cut and placed on top of fabric 140. Since system 110 also equally anticipates the use of individual, pre-cut appliques 135, instead of the use of a spool of applique material 130, sheets 135 of FIG. 2B would enter system 110 at cutting and combining station 160. Sheets 135 are delivered by a machine (not shown) from a table 137.

Whether roll 130 or sheets 135 are used, after cutting and combining station 160, the combined fabric 180 then enters compressing and heating station 170 where a pressure and heat combination capable of both activating the coating located between second side 124 of fabric 120 and fabric 140 and activating the transfer of the design element from applique material 130 or applique sheets 135 onto first side 122 of fabric 120 is applied for a certain period of time. The completed combined fabric 180 exits compressing and heating station 170 and is received onto spool 117 for transport to a cutting and sewing location.

It is equally anticipated by the invention that hook and loop fabric 120 would have the coating material applied by an outside, independent contractor. In this event, coating station 150 would not be needed.

The invention also anticipates the replacement of fabric spools 30 and/or 140 of systems 10 and 110, respectively, by a conveyor belt system (not shown). In such a conveyor belt system, pre-cut fabric, cut into the shape of the garment, will be placed on and ride through the respective systems on the conveyor belt. All of the stations of systems 10 and 110 will be applied as previously stated.

The result of using the systems described above is a garment having uniformly and unremovably attached thereto, hook and loop fabric, wherein the hook and loop fabric has a design element thereon. It has previously been impossible to print a design element onto a hook and loop fabric so as to have the hook and loop fabric part of, or totally represent, the design feature of the garment while maintaining the total intregity of the hook and loop engagement.

As was described earlier in this specification, earlier garments having hook and loop fabric attached thereto failed to have the hook and loop fabric as part of the design on the garment. Examples of earlier uses of this type of system on a garment were as described in the background portion of this specification, where, for example, in a sunset design the different locations of the removable sun element were not able to match the coloring of the blue sky, and thereby stood out like sore thumbs.

Other uses of hook and loop fabric on garments in the prior art incorporated into an overall picture were, for example, in a picture of a football stadium or hockey rink, or other type of sporting event, where the portion of the stadium was printed on the regular garment fabric, and the playing surface was made of hook and loop fabric. In such a garment, the fan section of the picture, which appears on the standard garment fabric, would be multi-colored, while the hook and loop fabric would be either white or black, which would obviously not advance the theme of the overall picture.

By applying the system of the present invention, not only could one achieve a green and white striped football field, a white hockey surface with blue and red lines and goalie boxes, but other design features could also be printed on the hook and loop fabric. For example, football players, goal posts and referees could be placed upon the hook and loop fabric of the invention to enhance the overall picture of a football game.

Obviously, in addition to enhancing the types of garments previously made having hook and loop fabric removable elements, as stated above, other types of innovative design elements can now be applied to both hook and loop fabric and underlying garment fabric so as to achieve any underlying ornamental design for use thereon of removable decorative elements.

In addition to the above benefits, the manner of attaching the hook and loop fabric to the underlying fabric or garment prevents separation of the two materials due to washing. In particular, by using the one-step system of the invention, which calls for use of a heat and pressure sensitive coating between the hook and loop fabric and the underlying fabric or garment, a unitary structure is realized. This structure, unlike the structures resulting from previously used methods of attaching hook and loop fabrics to other fabrics (i.e., sewing), fuses the two fabrics to overcome the inherent differences normally experienced after washing these two fabrics because of their different shrinkage coefficients.

Figure 3:
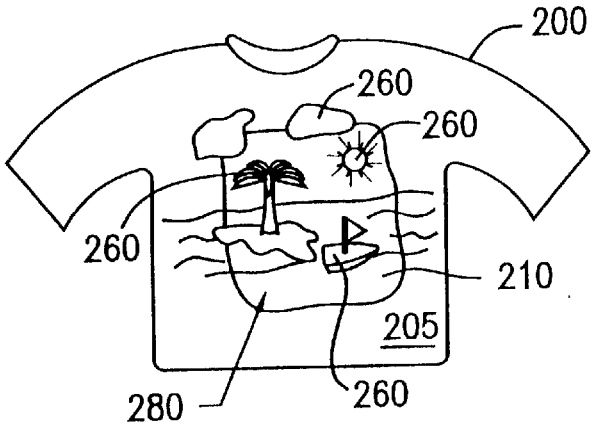
FIG. 3 is an elevational view of a garment having a hook and loop fabric adhered thereto, wherein the hook and loop fabric has an ornamental design printed thereon.
Figure 4:
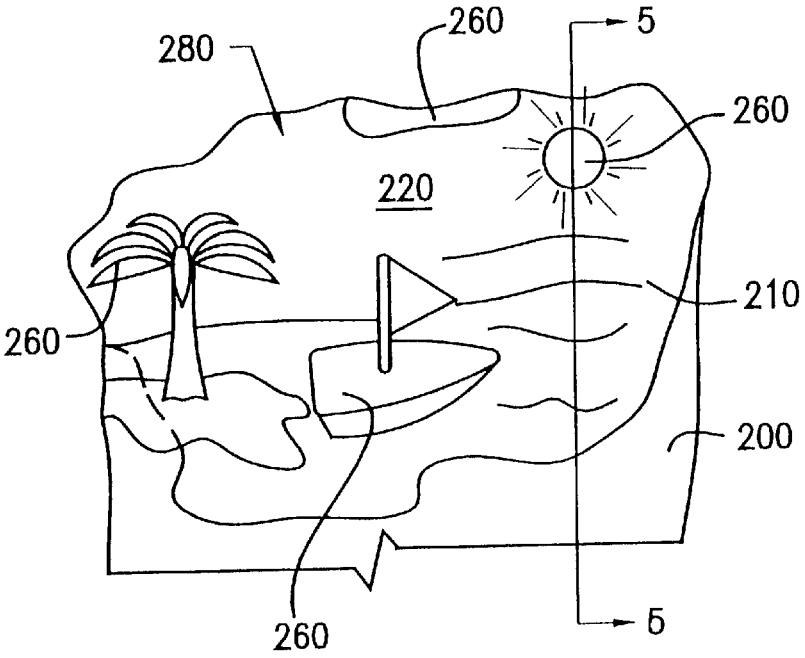
FIG. 4 is a partial elevational view of the same garment of FIG. 3, but having removable ornamental pieces affixed to the hook and loop fabric.
Figure 5:
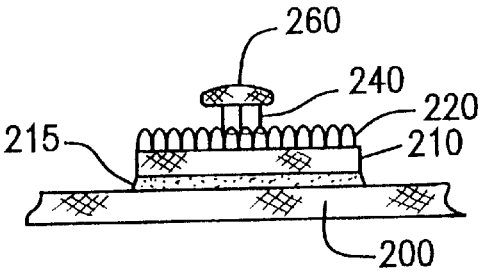
FIG. 5 is a cross-sectional view taken along line 5—5 of FIG. 4.

A garment having a printed hook and loop fabric thereon, and its corresponding removable decorative element are shown in FIGS. 3–5.

As seen in FIG. 3, a garment 200 has a rectangular shaped hook and loop fabric adhered thereto. It is of course anticipated that any shape of the hook and loop fabric could be used.

As seen in FIG. 5, the particular portion of the hook and loop fabric 210 applied to garment 200 by coating 215 is the loop portion 220. The corresponding hook portion 240 is applied, as shown in FIG. 5, to detachable ornamental piece 260.

It is also seen in FIGS. 3 and 4 that an ornamental design 280 is applied over both surface 205 of garment 200 and over loop portion 220 of hook and loop fabric 210. In this way, garment 200 is able to have an encompassing beautiful design 280 on both its surface 205 and on hook and loop fabric 210, is desired. In the alternative, the design could be located only on surface 220.

As seen in FIG. 4, detachable ornamental pieces 260, which interact and correspond with design 280, can be placed anywhere on the printed loop portion 220 of hook and loop fabric 210. Never before has such a garment been created. It is both ornamental and interactive, while satisfying the requirements of novelty and non-obviousness.

The system anticipates the use of a display format (not shown) comprising a preformed mock-up of the head, shoulders and chest of a person (not shown), a garment made pursuant to the invention placed thereover and sealed in some manner. It is also anticipated that the sealing mechanism will have a window therethrough for in-store application of a sample ornamental piece 260 onto the hook and loop fabric of the garment. The sample ornamental piece will be tethered to the display garment.

It will thus be seen that the objects set forth above, among those made apparent from the preceding description, are efficiently attained, and, since certain changes may be made in the above system or garment without departing from the spirit or scope of the invention, it is intended that all matter contained in the above description and shown in the accompanying drawings are to be interpreted as illustrative and not in a limiting sense.

It is also to be understood that the following claims are intended to cover all of the generic and specific features of the invention herein described and all statements of the scope of the invention which, as a matter of language, might be said to fall therebetween.

I claim:

1. A garment comprising a base fabric having a loop fabric of a hook and loop material fixedly adhered over at least a portion of said base fabric, said loop fabric having a design element printed thereon, and further comprising at least one selectively removable decorative element having a hook fabric extending therefrom of said hook and loop material, wherein said loop fabric comprises a plurality of loop elements extending therefrom, each of said loop elements comprising a looped surface area, said design element being printed onto at least a portion of said looped surface area simultaneously with said adhesion of said loop fabric to said base fabric, wherein the steps of simultaneously printing and adhering said loop fabric to said base fabric, are as follows:

applying a heat and pressure activated coating to a first side of said loop fabric;

placing said first side of said loop fabric over a portion of said base fabric;

flash heating said base fabric and said loop fabric to commence activation of said coating;

applying printing material to at least a portion of a second side of said loop fabric; and compressing and heating said loop fabric onto said base fabric at a temperature, pressure and time period appropriate to complete activation of said coating so that said coating fixedly adheres said loop fabric to said base fabric and also appropriate to activate said printing material to print said at least a portion of said second side of said loop fabric;

wherein said garment maintains the integrity of said loop fabric on said printed second side thereof, for receipt thereon of at least one selectively removable decorative element having at least a portion thereof covered with a cooperative element of said hook and loop material.

2. A garment as recited in claim 1, wherein said method of making said garment comprises the additional step of engaging a protective mesh between said second applying step and said compressing step, said protective mesh to be engaged over said second side of said loop fabric already having said printing material thereon, so as to prevent said loop fabric from substantially flattening, thereby aiding in maintaining the integrity of said loop fabric for receipt thereon of said at least one selectively removable decorative element.

3. A garment as recited in claim 1, wherein said design element is multi-colored.

4. A garment comprising a base fabric having a loop fabric of a hook and loop material fixedly adhered over at least a portion of said base fabric, said loop fabric having a design element printed thereon, and further comprising at least one selectively removable decorative element having a hook fabric extending therefrom of said hook and loop material, wherein said loop fabric comprises a plurality of loop elements extending therefrom, each of said loop elements comprising a looped surface area, said design element being printed onto at least a portion of said looped surface area simultaneously with said adhesion of said loop fabric to said base fabric, wherein the steps of simultaneously printing and adhering said loop fabric to said base fabric, are as follows:

applying a heat and pressure activated coating to a first side of said loop fabric;

placing said first side of said loop fabric over said base fabric;

applying an applique having printing material thereon over at least a portion of a second side of said loop fabric; and compressing and heating said loop fabric onto said base fabric at a temperature, pressure and time period appropriate to activate said coating so that said coating fixedly adheres said loop fabric to said base fabric and also appropriate to activate said applique to print said at least a portion of said second side of said loop fabric;

wherein said garment maintains the integrity of said loop fabric on said printed second side thereof for receipt thereon of at least one selectively removable decorative element having at least a portion thereof covered with a cooperating structure of said hook and loop material.

5. A garment as recited in claim 4, wherein said design element is multi-colored.

6. Clothing of any type and nature, comprising:

at least one base fabric;

a loop fabric fixedly adhered over at least a portion of said at least one base fabric, wherein said loop fabric is a part of a hook and loop material having a plurality of loop elements extending therefrom, each of said loop elements comprising a looped surface area;

a design element printed onto at least a portion of said looped surface areas of said plurality of loop elements of said loop fabric; and at least one selectively removable decorative element having a hook fabric of said hook and loop material attached to a back of said decorative element;

wherein said loop fabric maintains the integrity of its structure after it is printed with said design and after it is adhered to said at least one base fabric, so that said loop fabric is able to engagingly receive said at least one selectively removable element.

7. Clothing as recited in claim 6, wherein said design element is multi-colored.

8. Clothing of any type and nature, comprising:

a unitarily constructed fabric comprising:

a base fabric having a first surface area defining the style and/or outline of said clothing, and further having a first coefficient of shrinkage;

a loop fabric of a hook and loop material, having a second surface area smaller than said first surface area of said base fabric and a second coefficient of shrinkage, adhered over a portion of said first surface area of said base fabric; and adhesion material for fixedly adhering said loop fabric over said portion of said first surface area of said base fabric so that said loop and base fabrics share a substantially identical coefficient of shrinkage wherever said loop fabric is fixedly adhered over said base fabric, so that during washing and driving of said clothing, said base and loop fabrics do not separate due to one or the other shrinking by different amounts;

a design element printed onto at least a portion of said loop fabric; and at least one selectively removable decorative element having a hook fabric of said hook and loop material attached to a back of said decorative element;

wherein said loop fabric maintains the integrity of its structure after it is printed with said design and after it is fixedly adhered to said at least one base fabric, so that said loop fabric is able to engagingly receive said at least one selectively removable element.

9. Clothing as recited in claim 8, wherein said design element is multi-colored.

* * * * *